United States Patent [19]

Nishida et al.

[11] 4,441,091

[45] Apr. 3, 1984

[54] LOW LOSS LEAKAGE TRANSMISSION LINE

[75] Inventors: Shigeo Nishida; Mitsunobu Miyagi, both of Sendai; Koichi Mikoshiba, Hitachi, all of Japan

[73] Assignee: Hitachi Cable Ltd., Tokyo, Japan

[21] Appl. No.: 400,818

[22] Filed: Jul. 22, 1982

Related U.S. Application Data

[63] Continuation-in-part of Ser. No. 170,232, Jul. 18, 1980, abandoned.

[30] Foreign Application Priority Data

Jul. 18, 1979 [JP] Japan ..... 54-91822

[51] Int. Cl.[3] ..... H01P 3/12

[52] U.S. Cl. ..... 333/242; 333/236

[58] Field of Search ..... 333/236, 239, 242, 248

[56] References Cited

U.S. PATENT DOCUMENTS 3,028,565 4/1962 Walker et al. ..... 333/239 X
3,078,428 2/1963 Miller ..... 333/242
3,386,043 5/1968 Marcatili et al. ..... 333/242 X
3,436,141 4/1969 Comte ..... 333/242 X
3,596,214 7/1971 Glaser et al. ..... 333/239

*Primary Examiner*—Paul L. Gensler
*Attorney, Agent, or Firm*—Sughrue, Mion, Zinn, Macpeak and Seas

[57] ABSTRACT

A low loss leakage transmission line including a cylindrical dielectric tube the wall thickness $d_2$ of which is selected to satisfy $$d_2 \simeq \sqrt{\frac{\epsilon_1}{\epsilon_2 - \epsilon_1}} \cdot \frac{n\lambda_0}{4},$$

where $\epsilon_1$ is the dielectric constant of the internal space within the tube, $\epsilon_2$ is the dielectric constant of the material which forms the tube, and n is a positive odd integer. A loss layer may be disposed around the cylindrical dielectric tube to capture any lost wave energy. In one embodiment, a plurality of cylindrical dielectric tubes of different dielectric constants are coaxially arranged with the wall thickness of each of the tubes satisfying the above formula.

5 Claims, 3 Drawing Figures

LOW LOSS LEAKAGE TRANSMISSION LINE

BACKGROUND OF THE INVENTION

This application is a continuation-in-part of application Ser. No. 170,232, filed July 18, 1980, now abandoned.

The present invention relates to a low loss leakage transmission line which provides low loss transmission over a frequency range of from microwave to optical.

Various techniques for transmission of signals in a frequency range from microwave to optical with a low loss using cylindrical dielectric tubes have been proposed. See, for instance, the specification of Japanese Published Patent Application No. 11128/1960 and Japanese Laid-Open Patent Application No. 106485/1977.

Japanese Published Patent Application No. 11128/1960 discloses a transmission line using a cylindrical film dielectric tube which acts as a surface wave transmission line. The transmission line is called an "O guide". The electromagnetic wave energy is concentrated in the dielectric structure during transmission. Therefore, in order to provide low loss transmission, it is necessary to use a dielectric tube which has a small dielectric loss and also to use a very thin-walled dielectric tube. However, it is impossible to transmit high frequency electromagnetic waves at a low loss with the dielectric structures heretofore available. Specifically, reduction of the wall thickness of the cylindrical dielectric tube causes problems in that the mechanical strength of the wall is decreased and it is difficult to manufacture such a thin cylindrical dielectric tube.

In the transmission line disclosed in Japanese Laid-Open Patent Application No. 106585/1977, gases of different dielectric constants are sealed respectively in the internal space and the external space of a cylindrical film dielectric structure similar to the O guide. Surface wave propagation is obtained by making the dielectric constant of the gas in the internal space larger than that of the gas in the external space.

In this version of a transmission line, a larger part of the energy of the waves is transmitted as the waves are propagated in the gases in the internal and external spaces. Therefore, the selection of gases having a low dielectric loss provides low loss transmission. However, since the gases must be sealed in the internal and external spaces of the cylindrical film dielectric structure, it is technically difficult to manufacture such a transmission line and it is also difficult to lay the transmission line and to inspect the transmission line while in use.

SUMMARY OF THE INVENTION

Unlike the prior art, surface wave propagation is not utilized with the present invention. That is, the invention utilizes the propagation of a leakage wave in which certain relationships are established between the wall thickness of a cylindrical dielectric structure and the wavelength of an electromagnetic wave propagating in the dielectric structure so that, even if air is present inside and outside of the cylindrical dielectric structure, low loss transmission can nonetheless be carried out. Thus, the invention provides a general purpose low loss leakage transmission line. Gases other than air may be present inside and outside of the cylindrical dielectric structure of the invention. In this case, it is not always necessary to make the dielectric constant inside the dielectric structure larger than that outside the dielectric structure.

More specifically, a low loss leakage transmission line of the invention includes a cylindrical dielectric tube, the wall thickness of which is defined by $$d_2 \cong \sqrt{\frac{\epsilon_1}{\epsilon_2 - \epsilon_1}} \cdot \frac{n\lambda_0}{4},$$

for $n=1, 3, 5, \ldots$, where $d_2$ is the wall thickness of the dielectric tube, $\epsilon_1$ is the dielectric constant of the internal space within the tube, $\epsilon_2$ is the dielectric constant of the material which forms the wall of the tube, $\lambda_0$ is the wavelength of the supported electromagnetic waves in free space, and n is a positive odd integer.

A low loss layer may be disposed around the outer surface of the cylindrical dielectric tube to recover any electromagnetic wave energy leaked from the cylindrical dielectric tube. The low loss layer should have a wall thickness large compared to the wavelength of the propagating electromagnetic waves.

In another embodiment, a plurality of cylindrical dielectric tubes of different dielectric constants are coaxially arranged in laminated form. The wall thickness of each of the cylindrical dielectric tubes is selected to satisfy the equation above. Again, a low loss layer may be covered with a metal tube for improving the shielding effect.

DESCRIPTION OF THE PREFERRED EMBODIMENTS

The invention will be described in detail with reference to the accompanying drawings.

Figure 1:
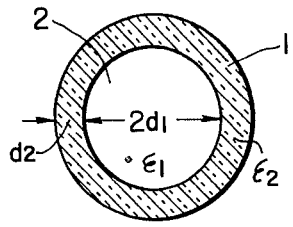
FIG. 1 is an explanatory diagram showing the fundamental arrangement of a low loss leakage transmission line according to the invention.

FIG. 1 shows a fundamental arrangement of a low loss leakage transmission line according to the invention. In FIG. 1, reference numeral 1 designates a cylindrical dielectric tube and reference numeral 2 designates the internal space within the dielectric tube 1.

The cylindrical dielectric tube 1 is preferably made of a dielectric material which has a relatively low dielectric loss. The inside diameter $2d_1$ of the tube 1 is large compared with the wavelength of the propagating waves. Air or another low loss gas is filled in the internal space 2.

The wall thickness $d_2$ of the dielectric tube 1 is selected as:

$$d_2 \cong \sqrt{\frac{\epsilon_1}{\epsilon_2 - \epsilon_1}} \cdot \frac{n\lambda_0}{4}$$

where $\epsilon_1$ is the dielectric constant of the internal space 2, $\epsilon_2$ is the dielectric constant of the dielectric tube 1, and $\lambda_0$ is the wavelength of the supported electromagnetic wave in free space, and n is a positive odd integer. (It may be noted that $\epsilon_1$ and $\epsilon_2$ may be either relative or absolute dielectric constants since only a ratio is involved.) The dielectric constant of the external atmosphere around the cylindrical dielectric tube 1 is also $\epsilon_1$, assuming that the same gas (which may be air) is on both sides of the tube.

With this construction, a leakage mode is established in which the energy of the electromagnetic wave in the dielectric tube 1 is a minimum while the energy of the electromagnetic wave leaked to the outside is also a minimum. Accordingly, a relatively large part of the electromagnetic wave energy propagates in the internal space 2, as a result of which low loss transmission is realized.

The transmission loss $\alpha$ in the transmission line of the invention is defined by the amount of leakage as the dielectric loss is negligibly smaller than the leakage loss. For instance, in a $TE_{01}$ leakage mode, the transmission loss can be represented by the equation $$\alpha\lambda_0 = \sqrt{\frac{\epsilon_1}{4(\epsilon_2 - \epsilon_1)}} \cdot \left(\frac{\lambda_0}{2d_1}\right)^4$$

As may be seen from the equation, the transmission loss is independent of the wall thickness $d_2$ of the cylindrical dielectric tube 1. Accordingly, even if the wall thickness $d_2$ is increased, low loss transmission is still provided. Because of this effect, there is no loger any difficulty involved in increasing the mechanical strength of the transmission line or in manufacturing the transmission line.

Figure 2:
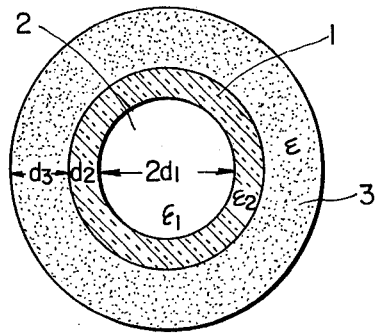
FIGS. 2 and 3 are explanatory diagrams showing two alternative embodiments of a low loss leakage transmission line of the invention.

In the above-described example, the electromagnetic wave is sustained in the leakage mode, and therefore a relatively larger part thereof propagates in the internal space of the cylindrical dielectric tube. Some of the energy of the electromagnetic wave may leak out of the cylindrical dielectric tube 1 representing a transmission loss. However, electromagnetic wave energy thus leaked can be recovered by the provision of a loss layer 3 (having a dielectric constant $\epsilon$) around the cylindrical dielectric tube 1 as shown in FIG. 2. It is preferable that the loss layer 3 be made of a material which has a suitable dielectric loss and a small dielectric constant ($\epsilon=\epsilon_1$), and that the wall thickness $d_3$ be large compared to the wavelength of the propagating electromagnetic waves. The outer wall of the loss layer 3 may additionally be covered with a metal tube for improving the shielding effect.

As an example of a low loss transmission line of the invention, quartz glass may be used for the material which forms the cylindrical dielectric tube. This material has a refractive index of 1.458, and therefore a relative dielectric constant of $1.458^2=2.126$. Assuming that air fills the dielectric tube, $n=41$, and $\lambda_0=10.6$ $\mu$m, $d_2$ is calculated to be 102.4 $\mu$m.

Figure 3:
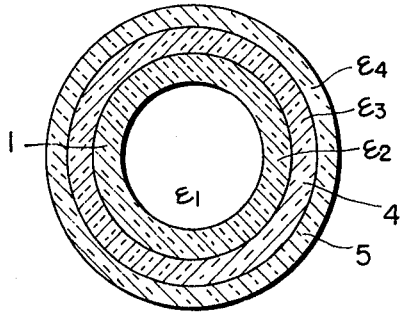

A modification of the transmission line shown in FIG. 2 is shown in FIG. 3. In this modification, the transmission line is in the form of a multi-layer tube. More specifically, cylindrical dielectric tubes 4 and 5 having different dielectric constants $\epsilon_3$ and $\epsilon_4$ are disposed around the first cylindrical dielectric tube 1. The thickness $d_i$ of each of the cylindrical dielectric tubes 1, 4 and 5 is selected to satisfy $$d_i \cong \sqrt{\frac{\epsilon_1}{\epsilon_i - \epsilon_1}} \cdot \frac{n\lambda_0}{4}$$

where $\epsilon_i$ is the dielectric constant of the respective tube.

As the transmission line is formed with cylindrical dielectric tubes 1, 4 and 5 of different dielectric constants, the transmission line can be considered as a quarterwave or odd multiple of a quarterwave impedance transformer when operated in a circuit, and therefore the parameters of the transmission line can be used to control the band of frequencies transmitted. If desired, a loss layer similar to that described above for the embodiment of FIG. 2 may be provided on the outer wall of the cylindrical dielectric tube 5 and the outer wall of the loss layer may be covered with a metal layer to provide a shielding effect.

As is clear from the above description, a transmission line constructed according to the invention utilizes a leakage mode in which electromagnetic waves propagate in the cylindrical dielectric tube, with the wall thickness $d_2$ of the cylindrical dielectric tube so selected to satisfy $$d_2 \cong \sqrt{\frac{\epsilon_1}{\epsilon_2 - \epsilon_1}} \cdot \frac{n\lambda_0}{4}.$$

With this arrangement, the larger part of the electromagnetic waves propagate in the internal space of the cylindrical dielectric tube. Thus, in the leakage mode, the amount of leakage is quite small and the dielectric loss is further reduced, thus providing very low loss transmission.

In the transmission line of the invention, air may be provided in the internal space and the wall thickness of the cylindrical dielectric tube may be reduced to some extent.

We claim:

1. A low loss leakage transmission line comprising: a cylindrical dielectric tube having a wall thickness $d_2$ defined by:

$$d_2 \cong \sqrt{\frac{\epsilon_1}{\epsilon_2 - \epsilon_1}} \cdot \frac{n\lambda_0}{4},$$

where:

$\epsilon_1$ is the dielectric constant of the space internal to the tube, $\epsilon_2$ is the dielectric constant of the tube, $\lambda_0$ is the wavelength of the supported electromagnetic waves in free space, and n is a positive odd integer.

2. A low loss leakage transmission line comprising: a cylindrical dielectric tube; and a loss layer disposed around the outer surface of said tube, wherein the wall thickness $d_2$ of said tube is defined by:

$$d_2 \cong \sqrt{\frac{\epsilon_1}{\epsilon_2 - \epsilon_1}} \cdot \frac{n\lambda_0}{4},$$

where:

$\epsilon_1$ is the dielectric constant of the space internal to the tube, $\epsilon_2$ is the dielectric constant of the tube, $\lambda_0$ is the wavelength of the supported electromagnetic waves in free space, and n is a positive odd integer.

3. A low loss leakage transmission line as claimed in claim 1 or 2, wherein said cylindrical dielectric tube comprises a plurality of cylindrical dielectric tubes of different dielectric constants coaxially arranged in laminated form, the wall thickness $d_i$ of each of said plurality of cylindrical dielectric tubes being defined by $$d_i \cong \sqrt{\frac{\epsilon_1}{\epsilon_i - \epsilon_1}} \cdot \frac{n\lambda_0}{4}$$

where $\epsilon_i$ is the dielectric constant of the respective ones of said plurality of dielectric tubes.

4. A low loss leakage transmission line as claimed in claim 2, wherein said cylindrical dielectric tube comprises a plurality of cylindrical dielectric tubes of different dielectric constants coaxially arranged in laminated form, the wall thickness $d_i$ of each of said plurality of cylindrical dielectric tubes being defined by $$d_i \cong \sqrt{\frac{\epsilon_1}{\epsilon_i - \epsilon_1}} \cdot \frac{n\lambda_0}{4}$$

where $\epsilon_i$ is the dielectric constant of the respective ones of said plurality of dielectric tubes; and wherein said loss layer is disposed around an outermost one of said dielectric tubes.

5. The low loss leakage transmission line of claim 1 or 2, further comprising an outer metal tube.

* * * * *